US006562538B2

(12) United States Patent
Miyamoto

(10) Patent No.: US 6,562,538 B2
(45) Date of Patent: May 13, 2003

(54) FULL COLOR IMAGE FORMING METHOD, AND TONER AND INTERMEDIATE TRANSFER MATERIAL FOR THE METHOD

(75) Inventor: Satoru Miyamoto, Mishima (JP)

(73) Assignee: Ricoh Company, LTD, Tokyo (JP)

( * ) Notice: Subject to any disclaimer, the term of this patent is extended or adjusted under 35 U.S.C. 154(b) by 0 days.

(21) Appl. No.: 10/052,377

(22) Filed: Jan. 23, 2002

(65) Prior Publication Data

US 2002/0132176 A1 Sep. 19, 2002

Related U.S. Application Data

(62) Division of application No. 09/636,734, filed on Aug. 11, 2000, now Pat. No. 6,355,389.

(30) Foreign Application Priority Data

Aug. 11, 1999 (JP) ..... 11-227552

(51) Int. Cl.[7] ..... G03G 9/08

(52) U.S. Cl. ..... 430/108.6; 430/137.1; 430/137.2

(58) Field of Search ..... 430/47, 45, 111.4, 430/108.6, 137.1, 137.2

(56) References Cited

U.S. PATENT DOCUMENTS

| | | | | |
|---|---|---|---|---|
| 4,666,804 A | | 5/1987 | Haneda et al. | |
| 5,288,577 A | | 2/1994 | Yamaguchi et al. | |
| 5,368,972 A | | 11/1994 | Yamashita et al. | |
| 5,380,616 A | | 1/1995 | Aoki et al. | |
| 5,387,488 A | | 2/1995 | Kaneko et al. | |
| 5,429,901 A | | 7/1995 | Muto et al. | |
| 5,840,456 A | | 11/1998 | Tomita et al. | |
| 5,932,388 A | * | 8/1999 | Umeno et al. | 430/108 |
| 5,998,074 A | * | 12/1999 | Miyamoto et al. | 430/106 |

FOREIGN PATENT DOCUMENTS

| | | |
|---|---|---|
| JP | 63194272 | 8/1988 |
| JP | 01149059 | 6/1989 |
| JP | 01177063 | 7/1989 |
| JP | 02198476 | 8/1990 |
| JP | 02212867 | 8/1990 |
| JP | 02213881 | 8/1990 |
| JP | 02213882 | 8/1990 |
| JP | 0324667 | 10/1991 |
| JP | 04284479 | 10/1992 |
| JP | 04303869 | 10/1992 |
| JP | 04303872 | 10/1992 |
| JP | 05193020 | 8/1993 |
| JP | 05204257 | 8/1993 |
| JP | 05273893 | 10/1993 |
| JP | 05303293 | 11/1993 |
| JP | 05307344 | 11/1993 |
| JP | 05313526 | 11/1993 |
| JP | 05323802 | 12/1993 |

* cited by examiner

*Primary Examiner*—John Goodrow
(74) *Attorney, Agent, or Firm*—Oblon, Spivak, McClelland, Maier & Neustadt, P.C.

(57) ABSTRACT

A full color image forming method including the steps of developing an electrostatic latent image formed on an image bearing member with a color toner to form a color toner image thereon; first transferring the color developer including a color toner image onto an endless intermediate transfer material while applying a developing bias thereto; repeating the above-mentioned steps a plurality of times using a plurality of different color developers to form a full color toner image on the intermediate transfer material; and second transferring the full color image onto a receiving material, wherein a weight of each of the color toner images formed on the image bearing member is from about 0.4 $mg/cm^2$ to about 1.5 $mg/cm^2$, and each of the color developers has a charge quantity not less than 15 $\mu C/g$ in an absolute value, and wherein the following relationship is satisfied with respect to each of the first color toner transferring steps: $5.4 \times Q1+90<Vb-V1<5.4 \times Q1+150$, wherein Vb represents the developing bias voltage (V), V1 represents a potential (V) of a background area of the electrostatic latent image, on which the color toner image is not to be formed, and Q1 is the charge quantity ($\mu C/g$) of the color developer.

26 Claims, 5 Drawing Sheets

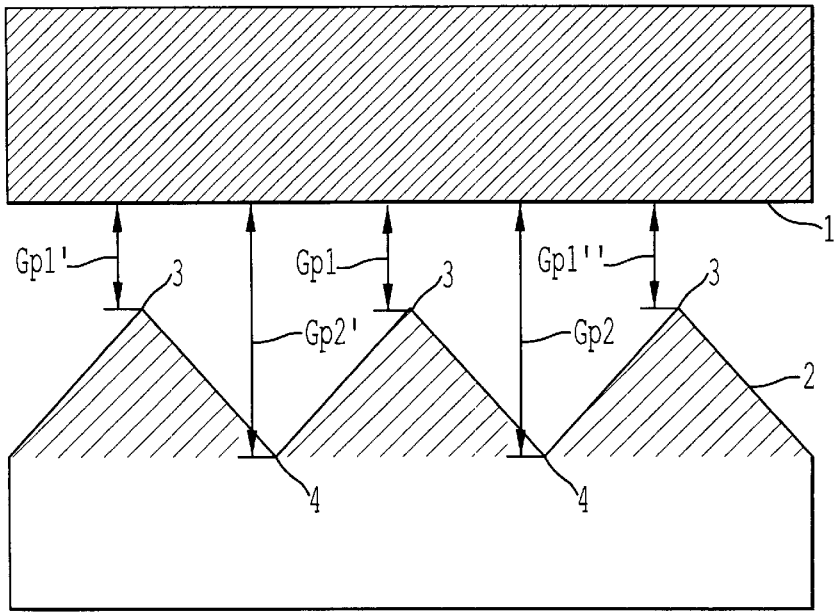
FIG. 1
FIG. 2A FIG. 2B FIG. 2C FIG. 2D
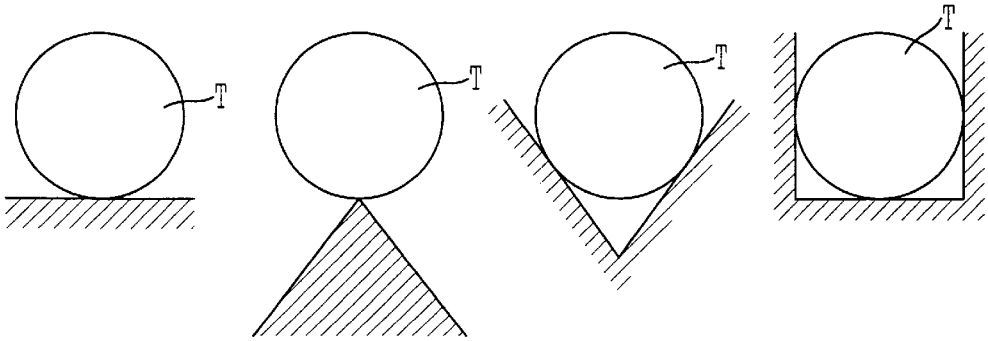

FULL COLOR IMAGE FORMING METHOD, AND TONER AND INTERMEDIATE TRANSFER MATERIAL FOR THE METHOD

This application is a Divisional application of application Ser. No. 09/636,734 filed on Aug. 11, 2000, now U.S. Pat. No. 6,355,389.

BACKGROUND OF THE INVENTION

1. Field of the Invention

The present invention relates to a full color image forming method for use in electrophotographic image forming apparatus such as copiers, printers and facsimiles, and a color toner and intermediate transfer material useful for the method. More particularly, the present invention relates to an electrophotographic full color image forming method using an intermediate transfer material which receives a full color toner image from one or more image bearing members and transfers the full color toner image to a receiving material to form the full color toner image thereon. In addition, the present invention relates to a method for manufacturing the color toner.

2. Discussion of the Background

Image forming methods and apparatus are well known in which a plurality of color images formed on one or more image bearing members such as photoreceptors are transferred onto an endless image transfer material one by one (i.e., a first transfer process) and all the first transferred color toner images are second transferred onto a receiving material at a time (i.e., a second transfer process). In particular, such an image forming method using an intermediate transfer material is used for a full color image forming apparatus in which an original image, which is separated into a plurality of color images, is reproduced by overlaying color toner images such as a black, cyan, magenta, and yellow toner image.

In such an image forming method and apparatus, a problem which occurs is that image omissions, which look as if an image is eaten by worms, are observed in resultant toner images formed on a receiving material. This is because omissions are formed on toner images formed in the first and second transfer process. In order to avoid such a problem, i.e., in order to improve transferability of toner images, the following techniques have been proposed:

(1) Techniques Concerning Surface Roughness of Intermediate Transfer Material

In attempting to avoid image omissions, Japanese Laid-Open Patent Publication No. 3-242667 discloses a technique which uses an intermediate transfer material which is made of an elastomer and which has a specific surface roughness to improve adhesion of the intermediate material with a receiving material.

In addition, Japanese Laid-Open Patent Publications Nos. 63-194272, 4-303869, 4-303872 and 5-193020 have disclosed techniques which use an intermediate transfer material which has a specific surface roughness to improve adhesion of the intermediate material with a receiving material.

When toner images are transferred in the first and second transfer process, a transfer bias voltage is typically applied. Therefore, discharging tends to occur between an image bearing member and an intermediate transfer material and between the intermediate transfer material and a receiving material. If the intermediate transfer material has sharp projections on the surface thereof, the electric field applied to toner images on the projected portions of the intermediate transfer material are greater than that applied to toner images on the recessed portions of the intermediate transfer material.

This reason will be explained in detail referring to FIG. 1. Numeral 1 denotes an electrode having a smooth surface. Numeral 2 denotes an electrode having a serrated surface. The electrode 1 and electrode 2 face each other with a gap (Gp) therebetween. Numeral 3 denotes a projected portion of the electrode 2, and numeral 4 denotes a recessed portion of the electrode 2. When a transfer bias voltage is applied to the electrodes 1 and 2, discharging mainly occurs at gaps Gp1, Gp1' and Gp1" formed between the electrode 1 and the projected portions 3 because the electric field at the gaps Gp1, Gp1' and Gp1" is relatively high compared to any other gaps formed between the electrodes 1 and 2 including gaps Gp2 and Gp2'. This is because the distance at the gaps Gp1, Gp1' and Gp1" is the shortest. This is true for the case in which the electrode 2 is replaced with an intermediate transfer material and the electrode 1 is replaced with a receiving material or an image bearing member.

When toner images on the intermediate transfer material having a rough surface are transferred, toner particles positioned on the projected portions are present in a relatively large electric field compared to toner particles positioned on the recessed portions. In addition, the toner particles on the recessed portions have a relatively large adhesion compared to the toner particles positioned on the projected portions. Therefore, the toner particles on the projected portions are transferred relatively easily compared to the toner particles on the recessed portions.

FIGS. 2A to 2D are schematic views illustrating several different cases in which a toner particle (T) adheres to an intermediate material having a serrated surface. In FIG. 2A, a toner particle T contacts the flat surface of the intermediate transfer material. In FIG. 2B, a toner particle T contacts a projected portion of the intermediate transfer material. In FIGS. 2C and 2D, a toner particle T contacts a recessed portion of the intermediate transfer material. As can be understood from FIGS. 2A to 2*d*, the toner particles as shown in FIGS. 2C and 2D have a relatively large contact area with the intermediate transfer material compared to the toner particles as shown in FIGS. 2A and 2B. In these cases, if the projected portions and the recessed portions are made of the same material, there is relatively large van der Waals force between the toner particles and the recessed portions (i.e., in the cases as shown in FIGS. 2C and 2D) compared to the cases as shown in FIGS. 2A and 2B. Therefore, the adhesion between the toner particle and the recessed portion is greater than that between the toner particle and the plat or projected portion. The toner on the recessed portions tends not to be easily transferred, resulting in occurrence of omissions in the resultant toner images.

Therefore, it is preferable that the intermediate transfer material has a relatively smooth surface such that the intermediate transfer material does not cause omissions in the transferred toner images. This is also true for the image bearing member Namely, it is preferable that the image bearing member such as a photoreceptor has a relatively smooth surface such that the photoreceptor does not cause omissions in the transferred toner images. It is well known to prepare photoreceptor drums including Se as a photosensitive material having a relatively smooth surface to impart good toner transferability to the photoreceptor drum.

However, it is hard to prepare an intermediate transfer material having such a smooth surface. Therefore, it is hard to avoid the omission problem.

(2) Techniques Concerning Difference in Feeding Speed Between Intermediate Transfer Material and Image Bearing Member and Between Intermediate Transfer Material and Receiving Material Japanese Laid-Open Patent Publication No. 2-213882 discloses a technique such that the feeding speeds of an intermediate transfer material and an image bearing member are specified to improve toner transferability and to avoid image omissions.

This technique will be explained referring to the first image transfer process (i.e., a toner image transfer process from an image bearing member to an intermediate transfer material).

When the intermediate transfer material has the same feeding speed as the image bearing member, it is needed to apply an electric force (i.e., a transfer electric field) to the toner image such that the toner image on the image bearing member, which adheres on the image bearing member due to the adhesion therebetween, is transferred to the intermediate transfer material only by the transfer electric field.

On the contrary, when the intermediate transfer material has a feeding speed different from that of the image bearing member, a mechanical force caused by the intermediate transfer material and the image bearing member which are fed at different speeds also acts to the toner image as well as the transfer electric field. Therefore, both the mechanical force and the transfer electric field can be applied to the toner image to transfer the toner image. Accordingly, this case is superior in toner transferability to the case in which the feeding speeds of the intermediate transfer material and the image bearing member are the same. Therefore, it is preferable for improving the image omission problem to use the method in which the intermediate transfer material has a feeding speed different from that of the image bearing member.

However, when the intermediate transfer material is fed at a feeding speed different from that of the image bearing member, the toner image tends to be distorted because the toner image is transferred while a shearing stress is applied thereto.

(3) Technique to Reduce Transfer Pressure

Japanese Laid-Open Patent Publications Nos. 1-177063 and 4-284479 have disclosed a technique in which the transfer nip pressure is specified.

This technique will be explained referring to the first image transfer process (i.e., a toner image transfer process from an image bearing member to an intermediate material).

When the first transfer process is performed, the image bearing member and the intermediate transfer material are pressed to each other by a mechanical force or an electrostatic force (this pressure is referred to as a transfer nip pressure). Namely, the toner that is present at a position between the image bearing member and the intermediate transfer material is pressed. When the toner is pressed, the toner particles are brought close to each other, resulting in increase of van der Waals force therebetween. In addition, the toner particles tend to aggregate, and therefore attraction between the materials constituting the toner particles also increases. Therefore, the toner tends not to be easily transferred.

From these reasons mentioned above, it is preferable that the transfer nip pressure should be decreased to improve the omission problem.

However, it is preferable to bring the intermediate transfer material close to the image bearing member of the receiving material for transferring the toner image to a desired position. From this viewpoint, the distance therebetween is preferably short. Therefore, there is a limit in decreasing the transfer nip pressure.

(3) Technique to Reduce Surface Energy of Intermediate Transfer Material

Japanese Laid-Open Patent Publications Nos. 2-198476 and 2-212867 have disclosed a technique in which the intermediate transfer material has a surface having a relatively small wettability to improve toner transferability thereof and to avoid the image omission problem.

At this point, the wettability means the adhesion between a liquid and a solid. The adhesion can be measured as an energy needed for separating the liquid from the solid. When the surface tension of the liquid is $\gamma$ A and the contact angle formed by the liquid and the surface of the solid is $\theta$, the adhesion W between the liquid and the solid is represented by the following equation (1):

$$W=\gamma A(1+\cos\theta) \tag{1}$$

The surface tension (critical surface tension) of a material X can be obtained as follows. Namely, a liquid having a surface tension of $\gamma A1$ is dropped on the material X to measure the contact angle ($\cos\theta 1$) formed by the liquid and the material X. This operation is performed with respect to various liquids having a different surface tension ($\gamma An$) to measure the contact angle ($\cos\theta n$). Points having coordinates of ($\cos\theta n$, $\gamma An$) are plotted on a graph (Zisman plot), and then the points are connected. This line is extended to determine the point at which the line crosses the line $\cos\theta=1$. The thus determined contact angle of the point, $\gamma e$, is the critical surface tension (i.e., the surface tension) of the material X.

In this case, when the wettability of various materials is measured using a liquid (for example, water), the surface tension $\gamma A$ in equation (1) is constant because the same liquid (water) is used. Therefore, the wettability is proportional to the contact angle ($\cos\theta$). Namely, to measure the wettability of various materials is measured using the same liquid is to obtain the contact angle ($\cos\theta$) at the same surface tension. On the other hand, the line obtained by Zisman plotting is typically a straight line. In addition, the gradients of the straight lines obtained by Zisman plotting with respect to various material are similar. Accordingly, by measuring the contact angles of materials using a liquid, the wettabilities of the materials can be compared to each other.

Japanese Laid-Open Patent Publications Nos. 2-198476 and 2-212867 have disclosed a technique in which an intermediate transfer material having a small wettability, i.e., an intermediate transfer material having a small surface energy, is used in attempting to avoid the image omission problem.

In addition, Japanese Laid-Open Patent Publications Nos. 5-204255, 5-204257 and 5-303293 have disclosed a technique, in which an intermediate transfer material having multiple layers whose surface layer includes a material having good releasability is used in attempting to attempt to improve the toner transferability and to avoid the image omission problem. Further, Japanese Laid-Open Patent Publication No. 2-213881 discloses a technique in which a material having good releasability is applied to the surface of an intermediate transfer material. These techniques attempt to improve toner transferability of the intermediate transfer material by imparting good toner releasing ability to the intermediate transfer material. Adhesion between two different materials can be represented as a function of the surface tension thereof. It is well known that the greater the surface tension, the greater the adhesion therebetween (e.g., between the toner and the intermediate transfer material). At this point, the surface tension is the synonym as the surface energy when pure materials are used. Therefore, the surface tension of a material, which is not a pure material, is used as a proxy of the surface energy as well as the proxy of the wettability.

In the technique mentioned above in paragraph (4), each of the adhesions between the toner and the image bearing member, between the toner and the intermediate transfer material, and between the toner and the receiving material is a combination force in which all physical forces such as electrostatic force, van der Waals force etc. are totaled.

By using this technique, the toner transferability can be improved in the second image transfer process. However, the toner transferability cannot be necessarily improved in the first image transfer process.

(5) Technique to Improve Toner Transferability by Refreshing Surface of Intermediate Transfer Material Japanese Laid-Open Patent Publications Nos. 5-273893, 5-307344, 5-313526 and 5-323802 have disclosed a technique in which it is attempted to maintain good toner transferability of an intermediate transfer material, i.e., it is attempted to avoid the image omission problem, by refreshing the surface of the intermediate transfer material to avoid toner filming. When the surface tension of an intermediate transfer material is reduced ideally, toner filming does not occur and therefore this technique (5) is not needed. Namely, the technique (5) is a supplementary technique for the technique (4).

In the second transfer process, the image omission problem tends to occur when roller transferring is performed, i.e., a roller is used as a transfer device. The reason is considered as follows:

(a) When a full color image is transferred, a large mechanical adhesion, which is a non-Coulomb force between the toner and the intermediate transfer material, is generated due to the pressure applied by the roller. The large adhesion is also caused by a thick toner layer because a full color toner image has a relatively large thickness. In detailed description, when the toner is pressed by a roller while an intermediate transfer material is present therebetween, the effective density of the toner is increased. In addition, since the toner particles are brought close to each other, the van der Waals force therebetween increases. Therefore, the adhesion of the toner to the intermediate transfer material increases.

(b) In a process in which an image forming process is repeatedly performed, when a toner filming problem occurs, i.e., when a toner film is formed on the surface of an intermediate transfer material, adhesion force is generated between the intermediate transfer material and the toner. In general, the intermediate transfer material is made of a material having a small surface tension or a small surface energy to avoid the toner filming problem. Even when such a material is used for the intermediate transfer material, adhesion (i) corresponding to the surface tension between the intermediate transfer material and the toner is generated. If toner filming once occurs, the adhesion between the intermediate transfer material and the toner changes to the adhesion force (ii) between the toner particles. At this point, it is obvious that the adhesion force (ii) is greater than the adhesion force (i). Therefore, toner images tend to adhere to the filmed toner, resulting in occurrence of the image omission.

In attempting to solve the image omission problem in the second transfer process, U.S. Pat. No. 5,053,827 (Method and apparatus for intermittent conditioning of a transfer belt) discloses the following method.

The method includes a conditioning process in which a roller (conditioning mean), which is constituted of a fluorine-containing material which has a surface energy smaller than that of an intermediate transfer belt, is brought into contact with the intermediate transfer belt to reduce the surface energy of the intermediate transfer belt.

In addition, the U.S. Patent discloses an embodiment including an intermediate transfer belt constituted of polycarbonate. In the embodiment, the initial surface energy of the intermediate transfer belt is from 37 to 38 dyne-cm. When the conditioning process is not performed, the surface energy of the intermediate transfer belt increases to 40 to 45 dyne-cm. When the surface energy is greater than 40 dyne-cm, an image transfer problem occurs. Therefore, as mentioned above, a roller constituted of a fluorine-containing material having a surface energy not greater than 30 dye-cm is brought into contact with the intermediate transfer belt to form a thin layer of the fluorine-containing material on the surface of the intermediate transfer belt, resulting in decrease of the surface energy of the intermediate transfer belt. In the US patent, it is described that when the surface energy is too low, an image transfer problem tends to occur in the first image transfer process, i.e., when a toner image is transferred from an image bearing member to the intermediate transfer material.

When the present inventor performs an experiment in which an intermediate transfer belt constituted of polycarbonate is used for the intermediate transfer material (19) of an image forming apparatus as shown in FIG. 3, the image omission problem occurs in the second image transfer process when the intermediate transfer belt is used for a long time. When a proper amount of a lubricant (zinc stearate) is applied to the intermediate transfer belt, the image omission problem in the second transfer process can be improved. However, the resultant copy image has low image density, i.e., the apparatus produces unclear copy images (hereinafter referred to as an unclear image problem) because the quantity of a toner image per unit area is small. When the present inventor examines the reason, it is found that an image transfer problem occurs in the primary transfer process.

When the present inventor performs an experiment in which an intermediate transfer belt constituted of ETFE (ethylene-tetrafluoroethylene copolymer) is used, the unclear image problem occurs from the start of the copying test. The reason for the unclear image problem is considered to be as follows. Although the surface energy of the intermediate transfer belt is controlled at a specific range by performing the conditioning process, the surface energy of the image bearing member gradually increases as the copying test is continuously performed even when the surface of the image bearing member is cleaned with a cleaning brush or roller. This is because (1) a toner adheres to the surface of the image bearing member; and (2) the surface of the image bearing member is contaminated by gases such as ozone, NOx and the like gases. When the surface energy of the image bearing member increases, the toner image formed on the image bearing member tends to remain thereon when the toner image is transferred to the intermediate transfer material, resulting in occurrence of the unclear image problem.

In addition, when the surface energy of the image bearing member decreases, another type transfer problem which tends to occur is that a color toner image transferred from the image bearing member to the intermediate transfer material is re-transferred to the image bearing member when another color toner image is transferred from the image bearing member or another image bearing member to the intermediate transfer material, resulting in occurrence of image omissions.

Thus, when the surface energy of the image bearing member is relatively high compared to that of the intermediate transfer material, toner images to be transferred from the image bearing member to the intermediate transfer material tend to remain on the image bearing member without being transferred, or toner images once transferred on the intermediate transfer material tend to be re-transferred to the image bearing member. The reason for that the image omission problem occurs in the initial copy images when an intermediate transfer material constituted of ETFE is used as mentioned above is considered to be that the surface energy of the image bearing member is much greater than that of the intermediate transfer material.

In attempting to avoid such a problem, the U.S. patent discloses a technique in which the conditioning process is performed only when the surface energy of the image bearing member becomes too high. Specifically, the U.S. patent proposes a method that the conditioning process is performed after predetermined copies are reproduced.

However, it is inconvenient that the conditioning process is performed while a copying operation is suspended. In addition, the surface energy of the image bearing member is not necessarily in the predetermined range when predetermined copies are reproduced. Further, a device for coating a lubricant on the intermediate transfer material and a device for polishing the intermediate transfer material are needed for the image forming apparatus, and thereby the apparatus becomes complex and the costs of the apparatus increase.

Several methods for improving the image omission problem by a toner are known. For example, a method is proposed in which toner transferability is increased by enhancing the fluidity of the toner, and a method in which a toner including resin particles is used to prevent the toner particles from being adhered to each other when the toner is transferred upon application of pressure thereto. However, when the fluidity of a toner is excessively increased, the toner images tend to scatter when the toner images are transferred, resulting in deterioration of image reproducibility.

Because of these reasons, a need exists for an image forming method which can produce color images having good image qualities such as good image reproducibility and which does not cause the image omission problem.

SUMMARY OF THE INVENTION

Accordingly, an object of the present invention is to provide a full color image forming method which can produce color images having good image qualities such as good image reproducibility and which does not cause the image omission problem.

Another object of the present invention is to provide a color toner for use in the color image forming method mentioned above, and a method for manufacturing the toner.

Yet another object of the present invention is to provide an intermediate transfer material for use in the color image forming method mentioned above.

Briefly these objects and other objects of the present invention as hereinafter will become more readily apparent can be attained by a full color image forming method including the steps of forming an electrostatic latent image on an image bearing member; developing the latent image with a color developer including a color toner to form a color toner image thereon; first transferring the color toner image onto an endless intermediate transfer material while applying a developing bias voltage; repeating the latent image forming step, latent image developing step and color toner transfer step several times using a plurality of color developers to prepare a full color image on the intermediate transfer material; and second transferring the full color toner image to a receiving material, wherein the amount of each color toner image formed on the image bearing member is from about 0.4 mg/cm$^2$ to about 1.5 mg/cm$^2$, and the absolute value of the charge quantity of each color developer is not less than 15 $\mu$C/g, and wherein the following equation is satisfied with respect to each of the first color toner transferring steps:

$$5.4\times Q1+90<Vb-V1<5.4\times Q1+150$$

wherein Vb represents the developing bias voltage (V), V1 represents a potential (V) of a background area of the electrostatic latent image formed on the image bearing member, on which the color toner image is not to be formed, and Q1 represents the absolute value of the charge quantity of each color developer. At this point, (Vb−V1) is referred to as a developing potential.

The color toner image is preferably formed on the image bearing member by developing the electrostatic latent image using a reverse developing method and a developing unit including a plurality of developing devices which rotates and each of which includes a magnetic brush and one of the color developers.

As another aspect of the present invention, a color toner is provided for the image forming method, which has a charge rising property Z not less than 70%, wherein the charge rising property Z is represented as follows:

$$Z=(Q20/Q600)\times 100$$

wherein Q20 represents a charge quantity of the toner when a carrier including the toner in an amount of not greater than 5% by weight is agitated for 20 seconds at a temperature of from 15 to 25° C. and a relative humidity of from 25 to 80%, and Q600 represents a charge quantity of the toner when the carrier including the toner in an amount of not greater than 5% by weight are agitated for 600 seconds at the condition.

The toner preferably includes a fluidity imparting agent including a particulate hydrophobic silica and a particulate hydrophobic titanium oxide, each of which has a particle diameter not greater than 0.05 $\mu$m.

The toner preferably has a circular degree of from 0.93 to 0.97 when the circular degree is measured with respect to the toner particles which remain on a sieve of 500 mesh having an opening of 26 $\mu$m after sieving the toner with the sieve. In addition, the toner particles remaining on the sieve of 500 mesh after sieving the toner of 100 g is preferably not greater than 10 mg.

As yet another aspect of the present invention, a method for manufacturing the color toner is provided which includes the steps of first pulverizing a kneaded toner mixture using a jet pulverizer including a collision plate and capable of blowing compressed air to prepare a particulate toner mixture; and second pulverizing and classifying the particulate toner mixture using a rotor pulverizer and a classifier which is connected with the rotor pulverizer while the pulverized toner mixture circulates through the rotor pulverizer and the classifier, wherein the rotor pulverizer includes a container and a rotor, which are concentric.

As a further aspect of the present invention, an intermediate transfer material for use in the image forming method is provided which has a volume resistivity of from $10^9$ to $10^{13}$ Ω·cm and whose surface has a friction coefficient not greater than 0.4.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 1 is a view for explaining the variation of electric field formed between an electrode 1 having a smooth surface and an electrode 2 having a rough surface;

FIGS. 2A to 2D are views for explaining how image omissions occur when toner images are transferred from an intermediate transfer material having a rough surface;

DETAILED DESCRIPTION OF THE INVENTION

In the image forming method of the present invention, color images are formed by overlaying three primary color toners, i.e., a cyan, magenta and yellow toner, on a receiving material. In addition, a black toner may be used.

The image forming method of the present invention will be explained in detail referring to FIG. 3.

Figure 3:
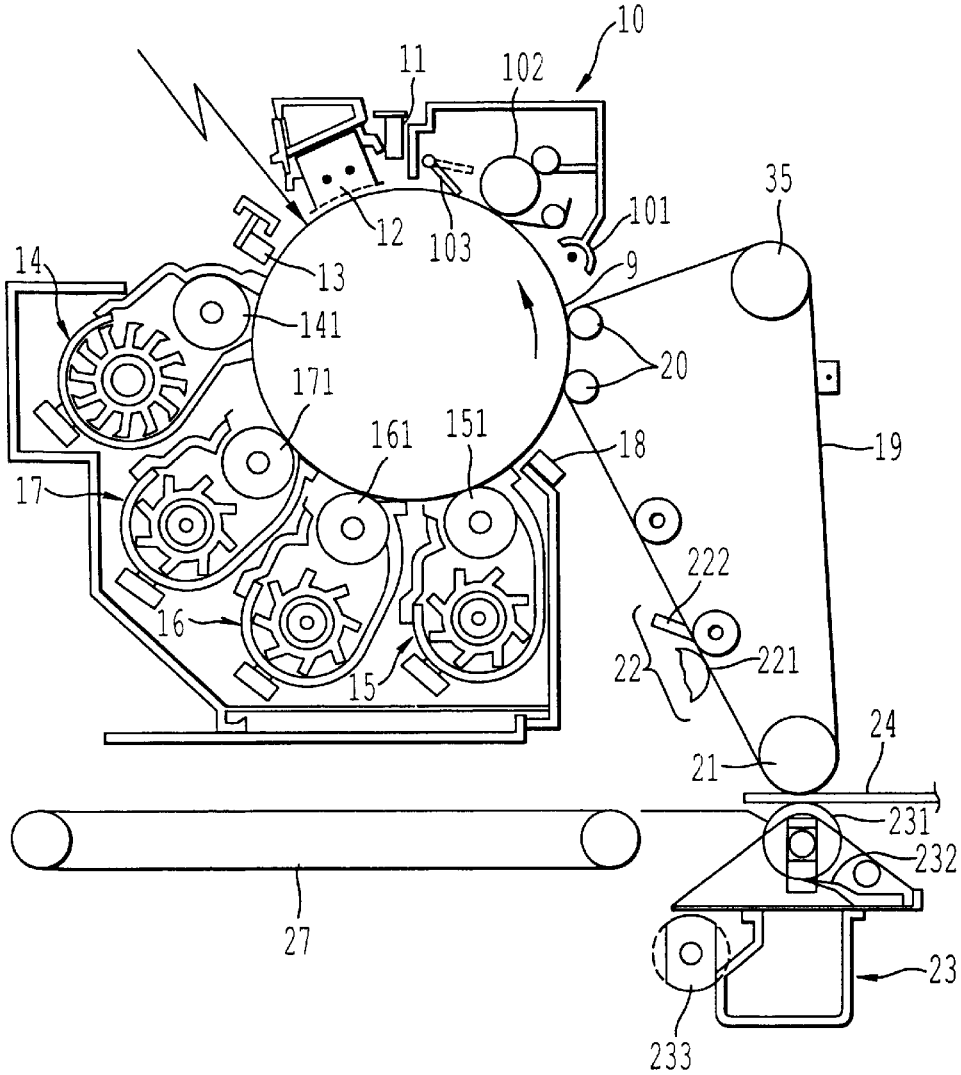
FIG. 3 is a schematic view illustrating a main part of an image forming apparatus in which the image forming method and the toner of the present invention are applied.

In FIG. 3, color image data, which are a color component constituting an original image and which have been sent from a color scanner (not shown), are converted to light signals (i.e., imagewise light) in an optical writing unit (not shown). Such an optical writing unit is well known and typically includes a laser diode, a polygon mirror, a polygon motor, focus lens, a reflection mirror and the like elements. A photoreceptor 9, which has been entirely charged, is exposed to the imagewise light. Thus, an electrostatic latent image is formed on the photoreceptor 9. The photoreceptor 9 rotates in the counterclockwise direction indicated by an arrow. Around the photoreceptor 9, a cleaning unit 10 including a pre-cleaning discharger 101, cleaning roller 102 and a cleaning blade 103, a discharging lamp 11, a charger 12, a potential sensor 13, a Bk developing device 14 which develops an electrostatic latent image to form a black image, a C developing device 15 which develops an electrostatic latent image to form a cyan image, an M developing device 16 which develops an electrostatic latent image to form a magenta image, a Y developing device 17 which develops an electrostatic latent image to form a yellow image, a developing pattern detector 18, an intermediate transfer belt 19 etc. are provided. The pattern detector 18 detects the reflectivity of a toner image formed on the photoreceptor 9. A suitable developing bias is applied according to this reflectivity information. In each of the developing devices 14 to 17, a developing sleeve 141, 151, 161 or 171 is provided. The developing sleeve 141 (or 151, 161 or 171) rotates to feed a Bk (or C, M or Y) developer contained in the Bk (or C, M or Y) developing device 14 (or 15, 16 or 17) so as to face the photoreceptor 9. In addition, a developing paddle which rotates for agitating the toner, a toner concentration detector etc. are included in each of the developing device. Hereinafter, the image forming method will be explained while assuming that developing operations are performed in the order of Bk, C, M and Y color. The order of the developing operations is not limited thereto.

Figure 6:
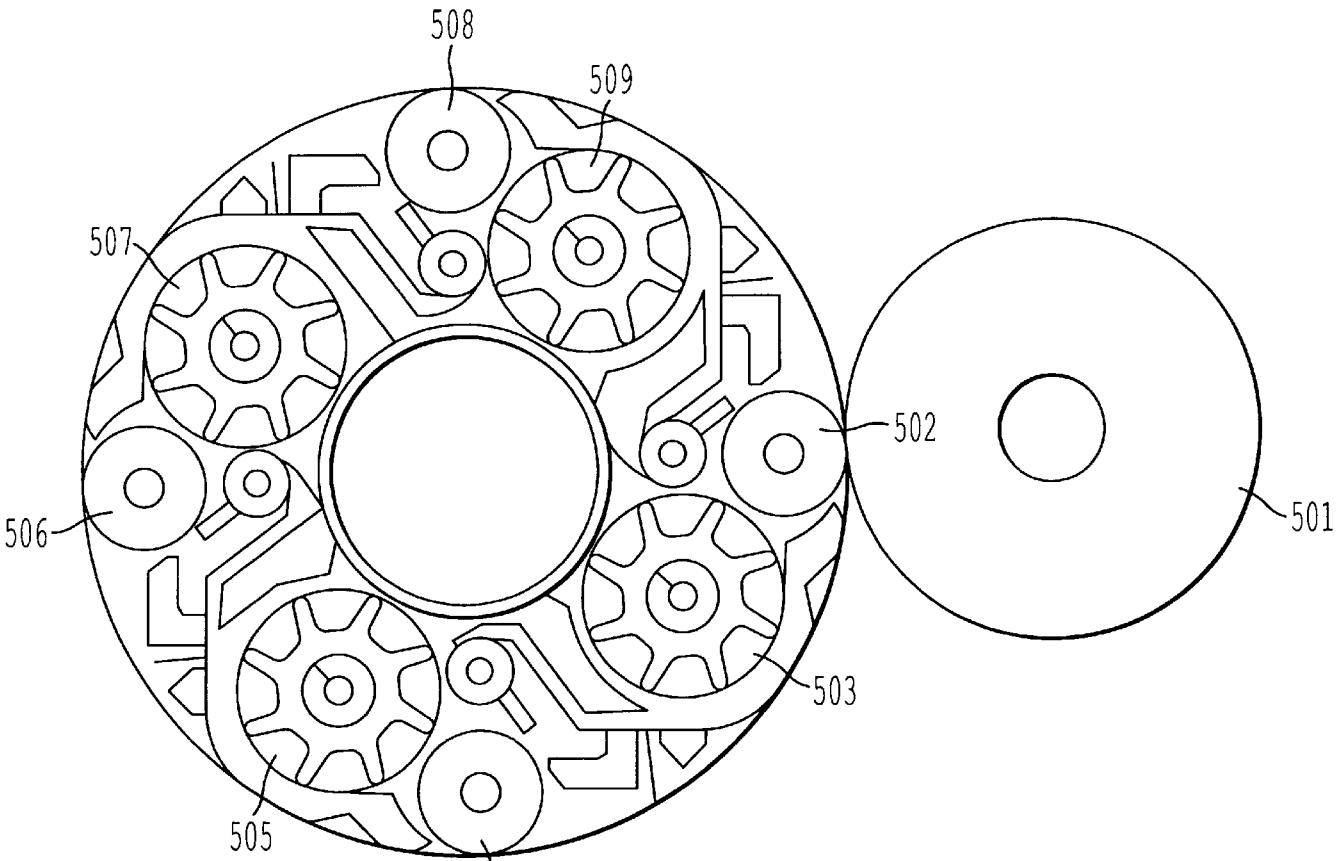
FIG. 6 is a schematic view illustrating a rotatable developing unit for use in the image forming method of the present invention.

In the present invention, it is preferable to use a developing unit which rotates to form a plurality of different color images. FIG. 6 is a view illustrating an embodiment of the rotatable developing unit.

In FIG. 6, numeral 501 denotes an image bearing member which bears an electrostatic latent image. Numerals 502, 504, 506 and 508 denote developing sleeves for a yellow, magenta, cyan and black developer, respectively. Numerals 503, 505, 507 and 509 denote developing paddles for a yellow, magenta, cyan and black developer, respectively. For example, a yellow latent image is developed with a yellow developer formed on the sleeve 502 to form a yellow toner image on the image bearing member 501. After the yellow toner image is transferred to, for example, an intermediate transfer belt (not shown), a magenta latent image is formed on the image bearing member 501. The magenta latent image is developed with a magenta developer formed on the sleeve 504 to form a magenta toner image on the image bearing member 501. The magenta toner image is transferred on the intermediate transfer belt on which the yellow toner image has been transferred. This operation is repeated with respect to a cyan and black toner. Thus full color toner image is formed on the image bearing member 501. The full color toner image is then transferred on a receiving material (not shown).

The image forming method of the present invention will be explained in detail. An image of an original is read with a color scanner. The photoreceptor 9, which has been entirely charged, is exposed to imagewise laser light based on the black image data of the read image. Thus an electrostatic latent image (hereinafter referred to as a Bk latent image) is formed on the photoreceptor. The developing sleeve 141 is rotated so as to be able to develop from the tip edge of the Bk latent image with a Bk developer (hereinafter referred to as a Bk toner). This Bk developing operation is continued until the end of the Bk latent image passes though the Bk developing area. After the end of the Bk latent image passes though the Bk developing area, the Bk developing device 14 is allowed to achieve a non-developing state so as not to develop other color (C, M or Y) latent images.

The developing operation may be performed by a posi-posi developing method or a nega-posi developing method (i.e, a reverse developing method).

Then the Bk toner image formed on the photoreceptor 9 is transferred onto the intermediate transfer belt 19 which rotates at the same speed as that of the photoreceptor 9. The transferring of toner images from the photoreceptor 9 to the intermediate transfer belt 19 is hereinafter referred to as a first image transfer. The first image transfer is performed while the photoreceptor 9 contacts the intermediate transfer belt 19 and a transfer bias voltage is applied to the intermediate transfer belt 19 and the image bearing member. This first image transfer is repeated with respect to the other color (C, M and Y) toner images, which are obtained by color-separating the original image, to form a full color toner image on the intermediate transfer belt 19. The full color image is then transferred onto a receiving paper (hereinafter referred to as a second image transfer). The intermediate transfer belt 19 will be explained later in detail.

Then the photoreceptor 9, which has finished to transfer the Bk toner images and then has been entirely charged, is exposed to imagewise laser light based on the cyan image data of the original image read by the scanner. Thus a C latent image is formed on the photoreceptor. The developing sleeve 151 is rotated so as to be able to develop from the tip edge of the C latent image with a C developer (hereinafter referred to as a C toner). This C developing operation is continued until the end of the C latent image passes though the C developing area. After the end of the C latent image passes though the C developing area, the C developing device 15 is allowed to achieve a non-developing state so as not to develop other color (M or Y) latent images.

Then the first toner image transfer process is repeated with respect to the M toner image and Y toner image in this order.

The intermediate transfer belt 19 is wound around bias rollers 20, a drive roller 21 and a driven roller 35. The rotation of the drive roller 20 is controlled by a drive motor (not shown). A belt cleaning unit 22 has a brush roller 221 in which about a half portion of a brush is exposed, a rubber blade 222 etc. The belt cleaning unit 22 is allowed to be attached to or detached from the intermediate transfer belt 19 by a attaching/detaching mechanism (not shown). The belt cleaning unit 22 is allowed to be detached from the intermediate transfer belt 19 from the start of an image forming operation to the end of the first Y image transfer. When all the first image transfer processes are finished, the cleaning unit 22 is allowed to be attached to the intermediate transfer belt 19 at a predetermined time to clean the surface of the intermediate transfer belt 19 from which the full color toner image has been transferred onto the receiving paper.

An image transfer unit 23 has a transfer bias roller 231 (i.e., an electric field forming device for the secondary image transfer), a roller cleaning blade 232, a attaching/detaching device 233 which can attach/detach the transfer unit to/from the intermediate transfer belt 19, etc. The bias roller 231 is normally detached from the intermediate transfer belt 19. When the full color toner image formed on the intermediate transfer belt 19 is transferred onto the receiving paper 24, the bias roller 231 is timely attached to the intermediate transfer belt 19 by the attaching/detaching device 233 while a predetermined bias voltage is applied to the bias roller 231. Thus, the full color toner image is transferred onto the receiving paper 24. The receiving paper 24 on which the full color toner images are formed is then fed to a fixing device (not shown) by a paper feeding unit 27 to fix the full color toner image on the receiving paper 24. In the fixing device, the receiving paper 24 having the full color toner image thereon is allowed to pass through a nip between a fixing roller, whose temperature is controlled so as to be a predetermined temperature, and a pressure roller. Thus a full color copy is prepared.

After all the first image transfer operations are finished, the surface of the photoreceptor 9 is cleaned with the cleaning unit 10 and then uniformly discharged with the discharging lamp 11.

As mentioned above, a full color image is formed on a receiving material by first transferring color toner images formed on the photoreceptor 9 to the intermediate transfer belt 19 one by one and then secondarily transferring the color toner images from the intermediate transfer belt 19 to the receiving paper 19 at once.

In the present embodiment, only one photoreceptor 9 is used. However, a plurality of photoreceptors may be used. For example, each of the photoreceptors may bear a Bk image, a C image, an M image and a Y image.

When an electrostatic latent image formed on the photoreceptor 9 is developed, a developing potential is applied to the photoreceptor 9. The developing potential (Vb−V1) is controlled so as to fall in a proper range by detecting the image pattern to be developed with a developing pattern detector. When the developing potential is set so as to be higher than the proper range, a toner scattering problem (hereinafter sometimes referred to as a scattered toner image) in which toner particles are adhered around an image tends to occur in particular in the second image transfer process. On the contrary, when the developing potential is set so as to be lower than the proper range, the resultant toner image has a low image density. In addition, the image omission problem tends to occur.

As a result of the present inventor's examination, it is found that the scattered toner image is formed depending on the charge quantity of the toner used, the thickness of the toner layer formed on the intermediate transfer material and the like factors. When the developing potential is too high, toner particles having a relatively large charge quantity tend to be used for developing an electrostatic latent image. Therefore, the thickness of the toner layer becomes thick, resulting in formation of the scattered toner image. When the developing potential is too low, the thickness of the toner layer decreases, resulting in decrease of image density. In addition, when the thickness of the toner layer decreases, the image omission problem tends to occur unless the physical properties of the intermediate transfer material used and the transfer pressure have to be severely controlled. Namely, by controlling the developing potential so as to be in a proper range, the charge quantity of the developer (toner) and the thickness of the toner layer on the intermediate transfer material can be controlled SO as to be in a proper range. The charge quantity of the toner used is preferably uniform. However, in reality the charge quantity of the toner changes depending on the environmental conditions, the time during which the toner is used, and the like factors. Therefore, the developing potential is controlled so as to be in a proper range by checking the charge quantity of the toner used for developing with the developing pattern detector. As a result of the present inventor's examination, it is discovered that good images can be obtained when the quantity of the toner layer formed on the image bearing member is from about 0.4 $mg/cm^2$ to about 1.5 $mg/cm^2$, the charge quantity of the developer used is not less than 15 $\mu C/g$, and the following relationship is satisfied:

$$5.4\times Q1+90<Vb-V1<5.4\times Q1+150$$

wherein Vb represents a developing bias voltage (V), V1 represents the developing potential, i.e., the surface potential (V) of an area of the image bearing member which is exposed to imagewise light, and Q1 represents the absolute value of the charge quantity of each developer. At this point, (V−V1) is the developing potential.

When the quantity of the toner layer formed on the image bearing member is too large, the resultant toner image tends to have scattered toner particles around the image. In addition, when the quantity is to small, the image density decreases.

The present inventor also discovers that by imparting a charge rising property of not less than 70% to a toner, the toner transferability can be largely improved. As the factors of the toner transferability on the toner side, charge quantity, fluidity, electric resistance, shape of the toner particles, etc. are exemplified. Among these factors, the charge quantity, fluidity, and shape of a toner are especially important. In particular, when a toner has a good charge rising property, the toner can rapidly have a desired charge quantity due to the friction between the toner and a carrier or a blade. Therefore, the developing process and the transfer process can be effectively performed. In addition, it is possible to avoid the toner scattering problem in that the toner particles are scattered from the developing device, resulting in formation of background fouling in the resultant image and contamination of the inside of the image forming apparatus.

In the present invention, various fluidity imparting agents can be used. Among these various fluidity imparting agents, a combination of a particulate hydrophobic silica and a particulate hydrophobic titanium oxide is preferable. In particular, a combination of a particulate hydrophobic silica and a particulate hydrophobic titanium oxide, each of which has an average particle diameter not greater than 0.05 $\mu$m, is preferable. When such a combination fluidity imparting agent is mixed with a mother toner and agitated, the resultant toner can be easily charged in a developing device by being mixed with a carrier and agitated with a agitator without releasing the fluidity imparting agent. Therefore, good image without image defects such as omissions can be produced. In addition, toner particles, which remain on an image bearing member or an intermediate transfer material even after toner images are transferred, can be reduced.

Particulate titanium oxides have good stability when environmental conditions are changed, and can stably produce images having a uniform image density. Therefore, the addition quantity of a particulate titanium oxide is preferably greater than that of a particulate silica. The addition quantity of a particulate hydrophobic silica to a mother toner is preferably from 0.3 to 1.5% by weight, and the addition quantity of a particulate hydrophobic titanium oxide to the mother toner is preferably from 0.2 to 1.2% by weight. The thus prepared toner has good charge rising property. Namely, when such a combination fluidity imparting agent is added to a toner in an amount in the range mentioned above, images having good image qualities can be stably produced even when copying is repeatedly performed for a long time. In addition, the toner scattering problem can be avoided.

In order to avoid occurrence of image omissions and white spots, it is important that there are no aggregated toner particles and large toner particles. In general, when a toner is manufactured, the toner is sieved with a sieve after a fluidity imparting agent is added to the toner to remove aggregated toner particles and large toner particles. The present inventor discovers that large toner particles can be removed by such a sieving operation, but aggregated toner particles tend to pass through the sieve after being released. The released toner particles tend to re-aggregate after the sieving operation if the toner particles have a specific circular degree, and thereby the above-mentioned image defects (image omissions and white spots) are formed.

As a result of the present inventor's examination, it is found that when a toner having a sieving residue (i.e., residual toner particles on a sieve after sieving) having a high circular degree when the toner is sieved with a sieve having 500 mesh (its opening is 26 $\mu$m), the toner tends to produce images having image omissions and white spots. The reason is considered to be the following. When a toner is mixed with a fluidity imparting agent using a mixer having a rotor blade, the resultant toner tends to have a high circular degree and the fluidity imparting agent tends to be embedded into the toner particles due to melting of the toner particles if a high stress is applied to the toner. In particular, color toners typically include a binder resin having a relatively low softening point. Therefore, color toners tend to cause such problems due to a circular toner.

Specifically, it is found that a toner having a sieving residue, which is not greater than 10 mg and in which the toner particles have a circular degree of from 0.93 to 0.97 when 100 g of the toner is sieved with a sieve having 500 mesh, can produce good images without image defects. In addition, in order to prepare such a toner capable of producing good image without image defects, it is preferable that a toner and a fluidity imparting agent are mixed under conditions satisfying the following relationship:

$$50 \leqq (V \cdot T)/M \leqq 200$$

wherein V represents a rotation speed (m/sec) of the rotor blade when the toner and the fluidity imparting agent are mixed, T represents a time (sec) during which the toner is mixed with the fluidity imparting agent, and M represents a weight (kg) of the toner used for the mixing.

When a toner and a fluidity imparting agent are mixed under conditions such that (V·T)/M is less than 50, the fluidity imparting agent is not uniformly mixed with the toner, and thereby the resultant toner cannot acquire a desired fluidity. In addition, large particles of the fluidity imparting agent and fine toner particles on which the fluidity imparting agent does not adhere are included in the resultant toner, and therefore image omission problem tends to occur.

The toner of the present invention preferable has a volume average particle diameter not greater than 9 $\mu$m to produce images having good resolution. In general, when the particle diameter of a toner is decreased to improve image resolution, the fluidity and preservation property of the toner tend to deteriorate. However, even when a toner having a particle diameter not greater than 9 $\mu$m is used, the toner not only produces images having good resolution but also has good fluidity and good preservation property if the toner is subjected to a mixing treatment according to the above-mentioned toner mixing method, and a circularizing treatment (i.e., the second pulverizing operation using a rotor pulverizer), which will be explained in detail. In this case, it is preferable to prepare the toner so as to have a circular degree of from 0.93 to 0.97. In addition, it is preferable that the toner includes fine toner particles having a particle diameter not greater than 5 $\mu$m in an amount of not greater than 20% by weight. The thus prepared toner has good fluidity and good preservation property, and therefore the toner can be easily supplied to a developing unit. In addition, the toner can be rapidly charged in the developing unit, i.e., the toner has a good charge rising property.

In the present invention, the particle diameter and particle diameter distribution are measured using an instrument tradenamed as Coulter Counter TA II manufactured by Coulter Electronics, Inc. Measurements are performed by a method in which one percent aqueous solution of sodium chloride is used as an electrolyte, and the aperture is set so as to be 100 $\mu$m.

The circular degree is measured using a flow type particle analyzer tradenamed as FPIA-1000 manufactured by Toa Medical Electronics, Inc. The circular degree of the toner aggregates remaining on a sieve is measured after the toner aggregates are dispersed in a 1% aqueous solution of sodium chloride.

When the color toners of the present invention are used for an electrophotographic image forming apparatus in which electrostatic latent images formed on an image bearing member are developed with a developing unit which includes a plurality of developing devices each of which has a magnetic brush and which can rotate to develop the respective color latent image using a reverse developing method, the image qualities of the resultant full color image are dramatically improved. In such an image forming apparatus, a toner supplying hopper, which does not have an agitator useful for preventing a toner bridging problem, is typically provided. In addition, the developing unit does not include a screw for feeding a toner and therefore the color toners are supplied to the respective developing device using their weight while the developing unit is rotating. Therefore, when the color toners of the present invention are used for this developing unit, good images without image defects can be produced. This is because the toner of the present invention hardly generates toner aggregates.

The intermediate transfer material includes a fluorine-containing resin in the surface layer thereof. Specific examples of the fluorine-containing resins for use in the surface of the intermediate transfer material include polyvinylidene fluoride (PVdF), polytetrafluoroethylene (PTFE), tetrafluoroethylene-ethylene copolymers (ETFE), polychlorotrifluoroethylene (PCTFE), tetrafluoroethylene-hexafluoropropylene copolymers (FEP), tetrafluoroethylene-hexafluoropropylene-vinylidenefluoride copolymers (THV) and the like.

Among these resins, PVdF and THV are particularly preferable. In addition, the surface of the intermediate transfer material preferably has a coefficient of friction not greater than 0.4 in order that the image forming method of the present invention using an intermediate transfer material is satisfactorily performed. When the friction coefficient is greater than 0.4, the image omission problem tends to occur because the releasability of the intermediate transfer material deteriorates. In addition, when the friction coefficient is greater than 0.4, the friction between the cleaning blade and the intermediate transfer material increases, resulting in poor cleaning of the intermediate transfer material.

In order to impart a friction coefficient not greater than 0.4 to the intermediate transfer material, the materials mentioned above are preferably used.

The intermediate transfer material may include an additive to control the friction coefficient thereof. Specific examples of such an additive include low molecular-weight silicone compounds and fluorine-containing compounds such as silicone oils and fluorine-containing surfactants; silicone and fluorine-containing resin particles; inorganic solid lubricants such as mica, graphite, and molybdenum disulfide; natural waxes such as montan waxes, carnauba wax, and hardened caster oil; synthetic waxes such as fatty acid esters, fatty acid triglycerides, aliphatic alcohols, fatty acid monoamides, and fatty acid bisamides; polyolefin waxes such as polyethylene waxes, and polypropylene waxes; and the like materials.

In the present invention, the friction coefficient is measured using an instrument tradenamed as Friction Abrasion Analyzer DF. PM-SS manufactured by Kyowa Interface Science Co., Ltd.

In addition, the intermediate transfer material preferably has a volume resistivity of from about $10^9$ to about $10^{13}$ Ω·cm. When the volume resistivity is too low, discharging tends to occur when the intermediate transfer material contacts an image bearing member while a transfer bias is applied thereto, resulting in formation of images having image defects such as image omissions and scattered toner images. On the contrary, when the volume resistivity is too high, toner images cannot be transferred unless the transfer bias voltage is extraordinarily increased. Therefore, it is needed to control the volume resistivity so as to be in the above-mentioned proper range by including one or more inorganic or organic electroconductive material in the intermediate transfer material.

Specific examples of such inorganic electroconductive materials include known inorganic electroconductive materials such as carbon black, graphite, carbon fibers, metal powders, metal oxide powders, and electroconductive whiskers. Specific examples of such organic electroconductive materials include polyethylene oxide, polypyrrole, organic compound including a quaternary ammonium salt group, and the like materials. These materials can be used alone or in combination.

The volume resistivity of the intermediate transfer material is measured using an instrument (tradenamed as HIGH RESISTANCE METER) manufactured by Mitsubishi Chemical Corp.

The color toners of the present invention are preferably prepared by the following method.

Constituents of a mother toner are mixed and kneaded while heating using a conventional method. Then the mixture is cooled and first pulverized using a jet pulverizer having a collision plate and capable of blowing compressed air. The pulverized mixture is second pulverized using a pulverizer having a rotor and a container, wherein the rotor and the container are concentric. Then the second pulverized mixture is classified using an air classifier. The rotor pulverizer and the air classifier are connected, and therefore large particles of the second pulverized mixture can be returned to the rotor pulverizer to be re-pulverized. Namely, the mixture is second pulverized while being classified. By being pulverized by the rotor pulverizer, the mixture is circularized (the second pulverizing process is sometimes referred to as a circularizing treatment). Thus a mother toner is prepared. As mentioned above, the circular degree of the mother toner is preferably from 0.93 to 0.97. Therefore the second pulverizing process is controlled such that the resultant mother toner has a circular degree of from 0.93 to 0.97. When circular degree of the mother toner is not less than 0.98, aggregates of the toner tend to be formed. Therefore undesired images tend to be produced.

The mother toner is then mixed with a fluidity imparting agent to prepare a toner.

The thus prepared color toners can produce good images without image defects such as omissions.

The toner of the present invention includes at least a binder resin, a colorant, a releasing agent and a charge controlling agent. As the binder resin of the toner of the present invention, any known resins which have been used as a binder resin of conventional toners can be used.

Specific examples of the binder resins for use in the toner of the present invention include polymers of styrene and its derivatives, such as polystyrene, polychlorostyrene, and polyvinyl toluene; styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers; and other resins such as polymethyl methacrylate, polybutyl methacrylate, polyvinyl chloride, polyvinyl acetate, polyethylene, polypropylene, polyesters, polyvinyl butyral resins, polyacrylic acid resins, rosin, modified rosin, terpene resins, phenolic resins, aliphatic or alicyclic hydrocarbon resins, aromatic petroleum resins, chlorinated paraffins, and paraffin waxes. These materials can be used alone or in combination.

Suitable colorants include known dyes and pigments used for conventional color toners such as yellow, magenta, cyan and black color toners. Specific examples of the colorants include Nigrosine dyes, Aniline Blue, chalco oil blue, Du Pont Oil Red, Quinoline Yellow, Methylene Blue chloride, Phthalocyanine Blue, Phthalocyanine Green, Hansa Yellow , Rhodamine 6C Lake, Chrome Yellow, quinacridone, Benzidine Yellow, Malachite Green, Malachite Green hexalate, Rose Bengal, monoazo dyes and pigments, disazo dyes and pigments, and trisazo dyes and pigments. The content of a coloring agent in the toner of the present invention is preferably from about 1 to about 30 parts by weight, and preferably from about 3 to about 20% by weight, of the binder resin.

Suitable charge controlling agents for use in the toner of the present invention include known positive or negative charge controlling agents. When color toners are prepared, transparent controlling agents and white charge controlling agents are preferable to impart a good color tone to the resultant color toners.

Specific examples of the positive charge controlling agents for use in the toner of the present invention include quarternary ammonium salts, metal salts and metal complexes of imidazole and the like. Specific examples of the negative charge controlling agents for use in the toner of the present invention include complexes and salts of salicylic acid, organic boron salts, and calixaren compounds and the like compounds.

In order to impart a releasing ability to the toner, a wax can be added in the toner. Specific examples of the waxes include vegetable waxes such as candelilla wax, carnauba wax, rice wax, Japan wax, and jojoba oil; animal waxes such as beeswax, lanolin, and whale wax; mineral waxes such as montan wax, and ozokerite; fats and oils waxes such as hardened caster oil, hydroxy stearic acid, fatty acid amides, and phenolic fatty acid esters; and the like waxes. These waxes can be used alone or in combination.

The toner of the present invention may includes additives such as plasticizers, resistance controlling agents and the like to improve the thermal characteristics, electric characteristics, and physical characteristics. Specific examples of the plasticizers include known plasticizers such as dibutyl phthalate, and dioctyl phthalate. Specific examples of the resistance controlling agents include tin oxides, lead oxides, antimony oxides etc.

The toner of the present invention may include a fluidity imparting agent other than the above-mentioned fluidity imparting agents. Specific examples of such fluidity imparting agents include fine powders of silica, titanium oxide, aluminum oxide, magnesium fluoride, silicon carbide, boron carbide, titanium carbide, zirconium carbide, boron nitride, titanium nitride, zirconium nitride, magnetite, molybdenum disulfide, aluminum stearate, magnesium stearate, zinc stearate, fluorine-containing resins, acrylic resins etc. These materials can be used alone or in combination. The fluidity imparting agent preferably has a primary particle diameter not greater than 0.1 $\mu$m. In addition, the fluidity imparting agent is preferably hydrophobized with a silane coupling agent, a silicone oil or the like such that the agent has a hydrophobic degree not less than 40.

The hydrophobic degree is measured as follows:

(1) 50 ml of water is contained in a container of 200 ml, and 0.2 g of a fluidity imparting agent to be measured is added therein;
(2) the mixture is mildly stirred with a magnetic stirrer;
(3) methanol is added drop by drop using a buret whose tip edge is in the water;
(4) the total amount (A ml) of methanol added is determined when there is no fluidity imparting agent which is floating on the water/methanol solution.

The hydrophobic degree is determined as follows:

$$\text{Hydrophobic degree}=\{A/(50+A)\}\times 100(\%)$$

The toner of the present invention can be manufactured by any one of known methods. For example, the toner is prepared by the following method:

(1) a binder resin, a colorant, and a charge controlling agent are mixed in a proper ratio optionally with a releasing agent using a mixer such as a Henshel mixer, a ball mill or the like;
(2) the mixture is kneaded, while being heated, with a kneader such as an extrusion type continuous kneader having a screw, a two-roll mill, a three roll mill, a kneader applying pressure and the like kneaders;
(3) the kneaded mixture is cooled and then crushed with a crusher such as a hammer mill;
(4) the crushed mixture is first pulverized with a collision type pulverizer such as a jet mill; and
(5) the first pulverized mixture is subjected to a second pulverization treatment (i.e., a circularizing treatment) with a rotor pulverizer while classified by an air classifier which is connected with the rotor pulverizer.

Thus a mother toner can be prepared. When color toners are prepared, a master batch of a pigment or a dye, which is prepared by kneading a pigment or a dye and a part of the binder resin used for the toner, can be typically used as a colorant to improve the dispersibility of the colorant in the toner.

Specific examples of the collision type pulverizer include jet mills, hammer mills, ball mills, tube mills, vibration mills and the like. Among these pulverizers, jet pulverizers having a collision plate and capable of blowing jet air are preferably used. Specific examples of such jet pulverizers include an I type or IDS type collision pulverizer manufactured by Nippon Pneumatic Mfg. Co., Ltd.

Figure 4:
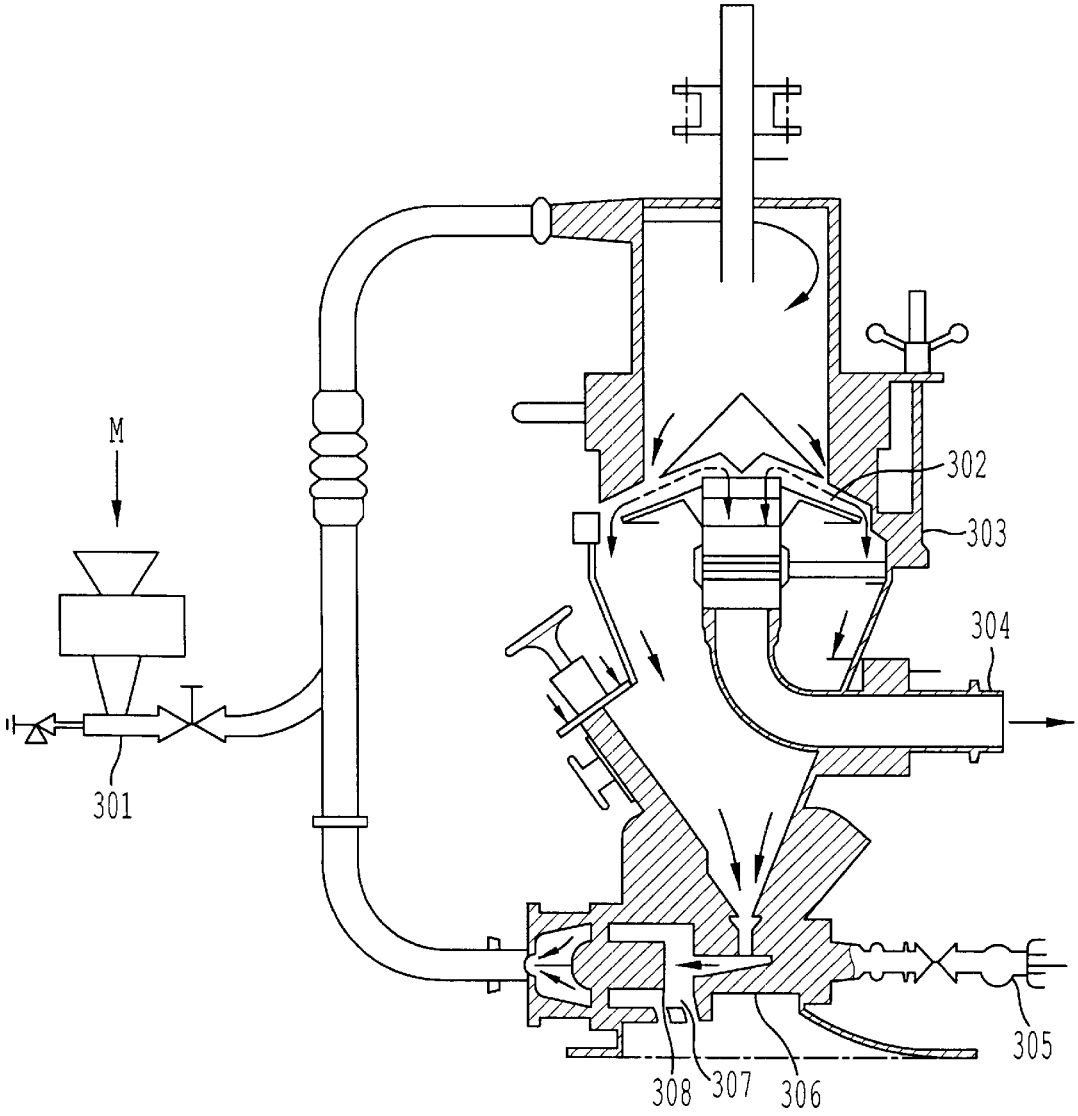
FIG. 4 is a schematic view illustrating a cross section of a jet pulverizer for use in the present invention.

FIG. 4 is a schematic view illustrating a cross section of an embodiment of the collision type pulverizer. When a material M is put into a hopper, the material M passes through a nozzle 301 and fed toward a classifying room 302. Fine particles are fed to a cyclone (not shown) through a pipe 304. A compressed air, which passes through a passage 305, is blown from a nozzle 306 toward a collision plate 308. Large particles of the material M are impacted to the collision plate 308, resulting in pulverization of the particles. The pulverized particles are fed to the classifying room 302 to be classified.

As the rotor pulverizer, roll mills, pin mills, fluidized bed type jet mills and the like are exemplified. Among these pulverizers, rotor pulverizers having a container which serves as an outer wall and a rotor which is concentric with the container are preferably used. Specific examples of such rotor pulverizers include Turbo Mills (manufactured by Turbo Industry Co., Ltd.), Kryptron (manufactured by Kawasaki Heavy Industries, Ltd.), and Fine Mills (manufactured by Nippon Pneumatic Mfg. Co., Ltd.).

Figure 5:
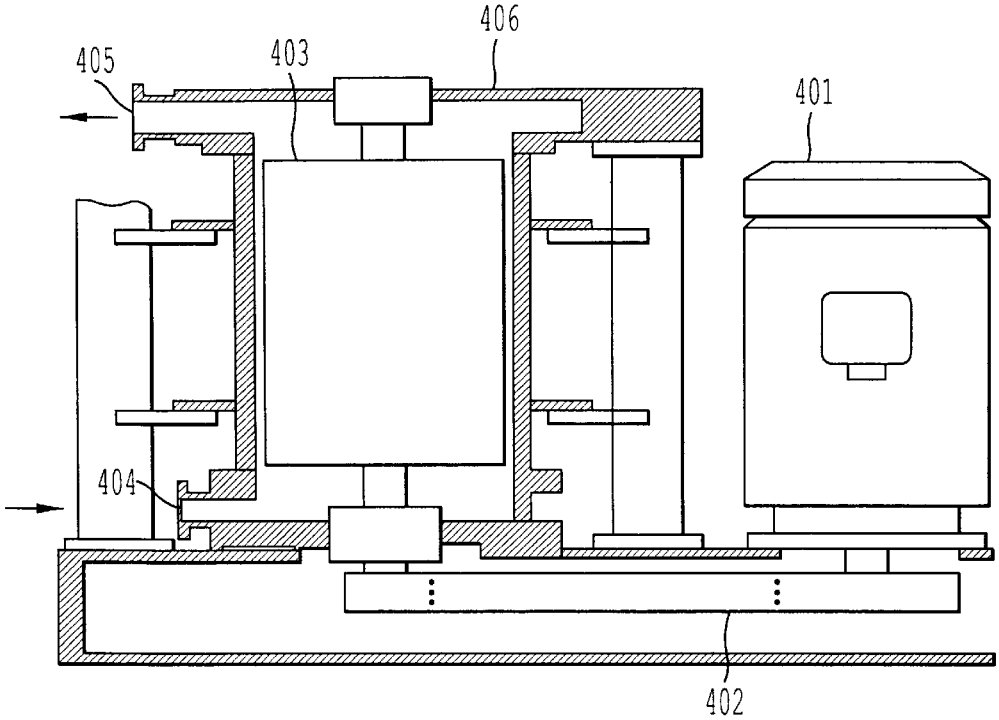
FIG. 5 is a schematic view illustrating a cross section of a rotor pulverizer for use in the present invention.

FIG. 5 is a schematic view illustrating the cross section of an embodiment of the rotor pulverizer. A material is fed from an entrance 404 with air. The material is pulverized with a rotor 403 which is rotated by a motor 401 using a belt 402. The pulverized material is fed to an exit 405. Numeral 406 denotes a container. The rotor 403 is concentric with the container 406.

Specific examples of the air classifier to be connected with the rotor pulverizer include dispersion separator (DS) type classifiers (manufactured by Nippon Pneumatic Mfg. Co., Ltd.), multi-partitioned classifiers (tradenamed as Elbow Jet manufactured by Nittetsu Mining Co., Ltd.) and the like.

In addition, it is possible to obtain fine toner particles by classifying the pulverized toner using an air classifier and a mechanical classifier.

The thus prepared mother toner is then mixed with a fluidity imparting agent using a Henshel mixer, super mixer, ball mill or the like, to prepare a toner.

The circular degree of a mother toner depends on a stay time during which the pulverized mixture is staying in the rotor pulverizer. For example, when using Kryptron system which does not have a classifier, the mixture pulverized with a jet pulverizer and fed to the rotor pulverizer is then fed to the following step without staying in the rotor pulverizer. In this case, the shape of the mixture passing through the rotor pulverizer is the same as that of the mixture pulverized with the jet pulverizer. In addition, difference in the fluidity and aggregation degree between the mixture pulverized with the jet pulverizer and the mixture passing through the rotor pulverizer is very small. Therefore, the image qualities are hardly improved.

The longer the time during which the pulverized mixture is staying in the rotor pulverizer (i.e., the more the amount of the pulverized mixture returned from the classifier), the more the pulverized mixture is circularized. However, as mentioned above, when the pulverized mixture is too circularized, the resultant toner tends to aggregate, resulting in formation of undesired images. The method of the present invention for manufacturing a toner is different from the method disclosed in Japanese Patent Publication No. 8-20762 (Japanese Laid-Open Patent Publication No. 1-149059), in which the surface of a toner is reformed in a relatively short time. In the present invention, an air classifier is essential. The pulverized mixture is appropriately circulated through a rotor pulverizer and an air classifier such that the resultant mother toner has a desired circular degree (i.e., from 0.93 to 0.97).

As the classifier to be connected with the rotor pulverizer, known air classifiers and mechanical classifiers can be used. In the present invention, air classifiers are preferably used. In particular, dispersion separator (DS) type air classifiers (manufactured by Nippon Pneumatic Mfg. Co., Ltd.) are preferable. This is because a powder including a releasing agent (i.e., the pulverized mixture) can be classified very effectively by spiral airflow supplied into the classifying room. The precision of classification using a multi-partitioned classifier, which utilizes Coanda effect, is inferior to that using the air classifier because a powder cannot satisfactorily dispersed. The precision of classification using a mechanical classifier is also inferior to the air classifier. In addition, it is hard to change the particle size of the mother toner to be prepared, because there are only few factors influencing the particle size. Further, it is troublesome to change the conditions of the mechanical classifier when a mother toner having a different particle size is prepared.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Toner

The following toner constituents were mixed and kneaded with a two-axis kneader while heated.

| | |
|---|---|
| Polyester resin (binder resin) | 100.0 |
| Phthalocyanine pigment (colorant) | 3.7 |
| Zinc salicylate (charge controlling agent) | 3.2 |

The kneaded mixture was cooled and then pulverized with a jet mill such that the volume average particle diameter of the pulverized mixture was 12 μm. In addition, the pulverized mixture was subjected to a surface treatment (i.e., a circularizing treatment or second pulverizing treatment) using a turbo mill and a dispersion separator (DS) type classifier which was connected with the turbo mill. The volume average particle diameter of the mixture was 11.5 μm. The surface-treated mixture was further classified to obtain a mother toner which had a volume average particle diameter of 12 μm and in which the ratio of the number of the particles having a particle diameter not greater than 5 μm to the number of total particles of the mother-toner was 22%.

The following components were agitated with a Henshel mixer.

| | |
|---|---|
| Above-prepared mother toner | 20 kg |
| Particulate hydrophobic silica (volume average particle diameter of 0.3 μm) | 100 g |
| Particulate hydrophobic titanium oxide (volume average particle diameter of 0.3 μm) | 100 g |

The mixing conditions were as follows:

Rotation speed (V) of rotor: 20 m/sec

Mixing time (T): 100 sec

Weight of toner: 20 kg

V·T/M: 100

Thus a cyan toner for electrophotography was prepared.

Preparation of Intermediate Transfer Material

The following components were mixed.

| | |
|---|---|
| Polyvinylidene fluoride (PVdF) | 100 |
| Carbon black | 10 |

A seamless intermediate transfer material was prepared by extrusion-molding the mixture.

Copying Test

A developer was prepared by mixing the above-prepared toner with a carrier. The charge quantity of the developer was 30 μC/g.

The above-prepared intermediate transfer material was set in each of electrophotographic full color copiers, PRETER 550 and PRETER 300. A copying test was performed using the above-prepared developer to evaluate the image qualities and durability of the toner. Image forming conditions were as follows:

Developing bias voltage (Vb): 466 V

Potential (V1) of a background area of an electrostatic latent image formed on the photoreceptor: 172 V

Example 2

The procedures for preparation of the developer and the intermediate transfer material, and for the copying test in Example 1 were repeated except that the polyvinylidene fluoride used for the intermediate transfer material was replaced with polycarbonate.

Example 3

The procedures for preparation of the developer and the intermediate transfer material, and for the copying test in Example 1 were repeated except that the addition quantity of the carbon black was changed to 1 part.

Example 4

The procedures for preparation of the developer and the intermediate transfer material, and for the copying test in Example 1 were repeated except that the addition quantity of the carbon black was changed to 30 part.

Example 5

The procedures for preparation of the developer and the intermediate transfer material, and for the copying test in Example 1 were repeated except that one of the fluidity imparting agents, particulate hydrophobic titanium oxide, was not added, and the image forming conditions were changed as follows:

Vb: 517 V

V1: 187 V

The charge quantity of the resultant developer was 38 μC/g.

Example 6

The procedures for preparation of the developer and the intermediate transfer material, and for the copying test in Example 1 were repeated except that one of the fluidity imparting agents, particulate hydrophobic silica, was not added, and the image forming conditions were changed as follows:

Vb: 389 V

V1: 149 V

The charge quantity of the resultant developer was 23 μC/g.

Example 7

The procedures for preparation of the developer and the intermediate transfer material, and for the copying test in Example 1 were repeated except that the average particle diameter of both the fluidity imparting agents was changed to 0.01 μm, and the image forming conditions were changed as follows:

Vb: 517 V

V1: 187 V

The charge quantity of the resultant developer was 38 μC/g.

Example 8

The procedures for preparation of the developer and the intermediate transfer material, and for the copying test in Example 7 were repeated except that the addition amount of the hydrophobic titanium oxide was changed to 60 g, and the image forming conditions were changed as follows:

Vb: 466 V

V1: 172 V

The charge quantity of the resultant developer was 32 μC/g.

Example 9

The procedures for preparation of the developer and the intermediate transfer material, and for the copying test in Example 7 were repeated except that the addition amount of the hydrophobic silica was changed to 60 g, and the image forming conditions were changed as follows:

Vb: 440 V

V1: 164 V

The charge quantity of the resultant developer was 28 μC/g.

Example 10

Preparation of Toner

The kneaded mixture prepared in Example 1 was pulverized with a jet mill such that the volume average particle diameter of the pulverized mixture was 8 μm. In addition, the pulverized mixture was subjected to a surface treatment (i.e., a circularizing treatment or second pulverizing treatment) using a turbo mill and a dispersion separator (DS) type classifier which was connected with the turbo mill. The volume average particle diameter of the mixture was 7.5 μm. The surface-treated mixture was further classified to obtain a powder which had a volume average particle diameter of 8 μm and in which the ratio of the number of the particles having a particle diameter not greater than 5 μm to the number of total particles of the powder was 22%.

The following components were agitated using a mixer having a rotor.

| | |
|---|---|
| Above-prepared powder | 20 kg |
| Particulate hydrophobic silica (volume average particle diameter of 0.01 μm) | 60 g |
| Particulate hydrophobic titanium oxide (volume average particle diameter of 0.01 μm) | 100 g |

The mixing conditions were as follows:

Rotation speed (V) of rotor: 20 m/sec

Mixing time (T): 100 sec

Weight of toner: 20 kg

V·T/M: 100

Thus a cyan toner was prepared.

Copying Test

A developer was prepared using the above-prepared toner. The charge quantity of the developer was 34 μC/g.

The above-prepared intermediate transfer material prepared in Example 1 was set in each of electrophotographic full color copiers, PRETER 550 and PRETER 300. A copying test was performed using the above-prepared developer to evaluate the image qualities and durability of the toner. Image forming conditions were as follows:

Developing bias voltage (Vb): 491 V

Potential (V1) of a background area of an electrostatic latent image formed on the photoreceptor: 180 V Example 11

The procedures for preparation of the developer and the intermediate transfer material, and for the copying test in Example 10 were repeated except that the ratio of the number of the particles having a particle diameter not greater than 5 μm to the number of total particles of the powder was 16%, and the image forming conditions were changed as follows:

Image Forming Conditions

Vb: 466 V

V1: 172 V

The charge quantity of the resultant developer was 32 μC/g.

Example 12

The procedures for preparation of the developer and the intermediate transfer material, and for the copying test in Example 11 were repeated except that the mixing conditions when preparing the toner were changed as follows:

V: 30 m/sec

T: 150 sec

V·T/M: 225

The charge quantity of the resultant developer was 32 μC/g.

Example 13

The procedures for preparation of the developer and the intermediate transfer material, and for the copying test in Example 11 were repeated except that the image forming conditions were changed as follows:

Vb: 414 V

V1: 156 V

Example 14

The procedures for preparation of the developer and the intermediate transfer material, and for the copying test in Example 11 were repeated except that the image forming conditions were changed as follows:

Vb: 491 V

V1: 180 V

Comparative Example 1

The procedures for preparation of the developer and the intermediate transfer material, and for the copying test in Example 1 were repeated except that the two kinds of fluidity imparting agents were replaced with 200 g of a particulate hydrophobic titanium oxide having a volume average particle diameter of 0.01 μm, and the image forming conditions were changed as follows:

Vb: 363 V

V1: 141 V

The charge quantity of the resultant developer was 13 μC/g.

Comparative Example 2

The procedures for preparation of the developer and the intermediate transfer material, and for the copying test in Example 1 were repeated except that the image forming conditions were changed as follows:

Vb: 389 V

V1: 149 V

Comparative Example 3

The procedures for preparation of the developer and the intermediate transfer material, and for the copying test in Example 1 were repeated except that the image forming conditions were changed as follows:

Vb: 517 V

V1: 187 V

Evaluation Methods

1. Image Omissions

Images of one-dot lines were reproduced before and after a running test. One line of the line images was observed by a microscope VH-5910, which was manufactured by Keyence Corp. and which was provided with a lens with a magnifying power of 200 (VH-200), to determine whether or not image omissions were observed. The images were classified into five grades which are as follows:

Rank 5: There is no image omission.

Rank 4: A few small image omissions, which could not be seen by naked eyes, were observed when observed by the microscope.

Rank 3: A large number of small image omissions, which could not be seen by naked eyes, were observed when observed by the microscope.

Rank 2: Relatively large image omissions, which could be clearly seen by naked eyes, were observed.

Rank 1: A large number of relatively large image omissions, which could be clearly seen by naked eyes, were observed.

Image omission of from rank 1 to rank 3 is not acceptable.

2. Toner Scattering (Scattered Toner Image)

The copied images were visually observed with or without a loupe whether toner scattering occurred around the image. The toner scattering was classified into the following 5 grades:

Rank 5: There was no toner scattering.

Rank 4: Toner scattering was not observed by naked eyes, but there was slight toner scattering when the image was observed using a loupe.

Rank 3: Toner scattering was hardly observed by naked eyes, but there were several points in the image, in which toner scattering was observed when the image was observed using a loupe.

Rank 2: Toner scattering was observed by naked eyes.

Rank 1: The image was blurred due to toner scattering.

Toner scattering of rank 1 to rank 3 is not acceptable.

3. Transferability of Toner

The number of copy sheets which were reproduced using a toner of 100 g, and the amount of the collected toner, i.e., the amount of the residual toner, were evaluated to determine the transferability of the toner which did not contribute to formation of an image. Namely, the more the number of copy sheets and the less the amount of the collected toner, the better the transferability of the toner.

4. Durability

Durability is defined as the number of produced images in the running test while the developer used can keep a charge quantity (Q/M) not less than 15 μC/g. The durability is also classified into the following four grades:

◎: Excellent

○: Good

Δ: Slightly poor

×: Poor

5. Resolution

Line images in which vertical and horizontal lines having line densities of 2.0, 2.2, 2.5, 2.8, 3.2, 3.6, 4.0, 4.5, 5.0, 5.6, 6.3, and 7.1 lines/mm were reproduced. The copied images were observed whether the line images were faithfully reproduced. The resolution was classified into the following four grades:

◎: Excellent

○: Good

Δ: Slightly poor

×: Poor

6. White Spots

Ten (10) solid images having an A3 size were continuously produced before and after the running test. The solid images were visually observed to determine whether white spots were observed therein. The white spots of the solid images were also classified into the four grades:

◎: Excellent

○: Good

×: Slightly poor

×: Poor

7. Circular Degree

The circular degree of a mother toner particle is defined as follows:

Circular degree=C/L wherein C represents a circumference of a circle having the same area as that of the section (i.e., a projected image when the particle is observed using an electron microscope) of the toner particle, and L is the circumferential length of the section of the toner particle.

TABLE 1

| | Developing conditions | | | Physical properties of intermediate transfer material | | Physical properties of toner | | |
|---|---|---|---|---|---|---|---|---|
| | Charge quantity (−μc/g) | Dev. Potential Vb−V1 (V) | Weight of toner image M/A (mg/cm$^2$) | Coefficient of Static friction | Vol. Resistivity ( · cm) | Circular degree | Weight of residue on 500-mesh sieve (mg/100 g) | Charge rising proerty (%) |
| Ex. 1 | 30 | 294 | 1.2 | 0.23 | $5.00 \times 10^{10}$ | 0.96 | 9 | 73 |
| Ex. 2 | 30 | 294 | 1.1 | 0.45 | $5.00 \times 10^{10}$ | 0.96 | 9 | 73 |
| Ex. 3 | 30 | 294 | 1.1 | 0.23 | $7.40 \times 10^{14}$ | 0.96 | 9 | 73 |
| Ex. 4 | 30 | 294 | 1.1 | 0.23 | $3.50 \times 10^{7}$ | 0.96 | 9 | 73 |
| Ex. 5 | 38 | 330 | 1.2 | 0.23 | $5.00 \times 10^{10}$ | 0.96 | 3 | 85 |
| Ex. 6 | 23 | 240 | 1.2 | 0.23 | $5.00 \times 10^{10}$ | 0.96 | 13 | 64 |
| Ex. 7 | 38 | 330 | 1.1 | 0.23 | $5.00 \times 10^{10}$ | 0.96 | 4 | 83 |
| Ex. 8 | 32 | 294 | 1.2 | 0.23 | $5.00 \times 10^{10}$ | 0.96 | 2 | 78 |
| Ex. 9 | 28 | 276 | 1.1 | 0.23 | $5.00 \times 10^{10}$ | 0.96 | 3 | 75 |
| Ex. 10 | 34 | 311 | 1.1 | 0.23 | $5.00 \times 10^{10}$ | 0.96 | 3 | 90 |
| Ex. 11 | 32 | 294 | 1.2 | 0.23 | $5.00 \times 10^{10}$ | 0.96 | 1 | 92 |
| Ex. 12 | 32 | 294 | 1.2 | 0.23 | $5.00 \times 10^{10}$ | 0.98 | 15 | 90 |
| Ex. 13 | 32 | 258 | 0.9 | 0.23 | $5.00 \times 10^{10}$ | 0.96 | 1 | 92 |
| Ex. 14 | 32 | 311 | 1.4 | 0.23 | $5.00 \times 10^{10}$ | 0.96 | 1 | 92 |
| Comp. Ex. 1 | 13 | 222 | 1.6 | 0.23 | $5.00 \times 10^{10}$ | 0.96 | 16 | 43 |
| Comp. Ex. 2 | 30 | 240 | 0.8 | 0.23 | $5.00 \times 10^{10}$ | 0.96 | 9 | 73 |
| Comp. Ex. 3 | 30 | 330 | 1.6 | 0.23 | $5.00 \times 10^{10}$ | 0.96 | 9 | 73 |

TABLE 2-1

| | Image qualities (PRETER 550) | | | | | |
|---|---|---|---|---|---|---|
| | Durability | Image omissions | Toner scattering | White spots | Resolution | Transferability |
| Ex. 1 | ◎ | 4 | 4 | ○ | ○ | ◎ |
| Ex. 2 | ◎ | 4 | 4 | ○ | ○ | ◎ |
| Ex. 3 | ◎ | 4 | 4 | ○ | ○ | ○ |
| Ex. 4 | ◎ | 4 | 4 | ◎ | ○ | ◎ |
| Ex. 5 | ◎ | 5 | 4 | ◎ | ○ | ◎ |
| Ex. 6 | ○ | 4 | 4 | ○ | ○ | ◎ |
| Ex. 7 | ◎ | 5 | 4 | ○ | ○ | ◎ |
| Ex. 8 | ◎ | 5 | 5 | ◎ | ○ | ◎ |
| Ex. 9 | ◎ | 5 | 5 | ◎ | ○ | ◎ |
| Ex. 10 | ◎ | 5 | 5 | ◎ | ◎ | ◎ |
| Ex. 11 | ◎ | 5 | 5 | ◎ | ◎ | ◎ |
| Ex. 12 | ◎ | 5 | 5 | ◎ | ◎ | ◎ |
| Ex. 13 | ◎ | 5 | 5 | ◎ | ◎ | ◎ |
| Ex. 14 | ◎ | 5 | 5 | ◎ | ◎ | ◎ |
| Comp. Ex. 1 | X | 3 | 2 | Δ | X | X |
| Comp. Ex. 2 | Δ | 2 | 3 | X | Δ | Δ |
| Comp. Ex. 3 | X | 3 | 2 | Δ | X | X |

◎: Excellent
○: Good
Δ: slightly poor
X: Poor

TABLE 2-2

| | Image qualities (PRETER 300) | | | | | |
|---|---|---|---|---|---|---|
| | Durability | Image omissions | Toner scattering | White spots | Resolution | Transferability |
| Ex. 1 | ◎ | 4 | 4 | ○ | ○ | ◎ |
| Ex. 2 | ◎ | 4 | 4 | ○ | ○ | ◎ |

TABLE 2-2-continued

| | Image qualities (PRETER 300) | | | | | |
|---|---|---|---|---|---|---|
| | Durability | Image omissions | Toner scattering | White spots | Resolution | Transferability |
| Ex. 3 | ◎ | 4 | 4 | ◎ | ○ | ○ |
| Ex. 4 | ◎ | 4 | 4 | ◎ | ○ | ◎ |
| Ex. 5 | ◎ | 5 | 4 | ◎ | ○ | ◎ |
| Ex. 6 | ○ | 4 | 4 | ◎ | ○ | ◎ |
| Ex. 7 | ◎ | 5 | 4 | ◎ | ○ | ◎ |
| Ex. 8 | ◎ | 5 | 5 | ◎ | ○ | ◎ |
| Ex. 9 | ◎ | 5 | 5 | ◎ | ○ | ◎ |
| Ex. 10 | ◎ | 5 | 5 | ◎ | ◎ | ◎ |
| Ex. 11 | ◎ | 5 | 5 | ◎ | ◎ | ◎ |
| Ex. 12 | ◎ | 5 | 5 | ◎ | ◎ | ◎ |
| Ex. 13 | ◎ | 5 | 5 | ◎ | ◎ | ◎ |
| Ex. 14 | ◎ | 5 | 5 | ◎ | ◎ | ◎ |
| Comp. Ex. 1 | X | 3 | 2 | Δ | X | X |
| Comp. Ex. 2 | Δ | 2 | 3 | X | Δ | Δ |
| Comp. Ex. 3 | X | 3 | 2 | Δ | X | X |

◎: Excellent
○: Good
Δ: Slightly poor
X: Poor

This document claims priority and contains subject matter related to Japanese Patent Application No. 11-227552, filed on Aug. 11, 1999, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A color toner having a charge rising property Z not less than 70%, and wherein the charge rising property Z is represented as follows:

$$Z=(Q20/Q600)\times 100$$

wherein Q20 represents a charge quantity of the toner when a carrier including the toner in an amount of not greater than 5% by weight is agitated for 20 seconds at a temperature of from 15 to 25° C. and a relative humidity of from 25 to 80%, and Q600 represents a charge quantity of the toner when the carrier is agitated for 600 seconds at a temperature of from 15 to 25° C. and a relative humidity of from 25 to 80%, wherein the toner when sieved with a sieve of 500 mesh, provides a residual toner remaining on the sieve having a circular degree of from 0.93 to 0.97 and a weight not greater than 10 mg when a pre-sieve weight is 100 g, and wherein the toner does not comprise a release agent.

2. The color toner of claim 1, further comprising a fluidity imparting agent comprising a particulate hydrophobic silica having a volume average particle diameter not greater than 0.05 μm and a particulate hydrophobic titanium oxide having a volume average particle diameter not greater than 0.05 μm.

3. The color toner according to claim 2, wherein the hydrophobic silica is present in an amount of from 0.3 to 1.5% by weight and the particulate hydrophobic titanium oxide is present in an amount of from 0.2 to 1.2% by weight.

4. The color toner according to claim 3, wherein the particulate hydrophobic titanium oxide is present in an amount of greater than that of the particulate hydrophobic silica.

5. The color toner according to claim 1, wherein the color toner has a volume average particle diameter not greater than 9 μm.

6. The color toner according to claim 1, wherein the color toner comprises fine color toner particles having a particle diameter not greater than 5 μm in an amount of not greater than 20% by number.

7. A method for manufacturing the color toner according to claim 1, comprising:

providing a mother toner of the color toner; and mixing the mother toner having a weight M in a unit of kilogram with a fluidity imparting agent to provide the color toner using the mixer having a rotor, wherein the following relationship is satisfied:

$$50\leqq(V\cdot T)/M\leqq 200$$

wherein V represents a rotation speed of the rotor in a unit of m/sec, and T represents a mixing time in a unit of second.

8. A method for manufacturing the color toner according to claim 1, comprising:

kneading a toner mixture comprising a binder resin, a colorant, a releasing agent and a charge controlling agent while heating;

cooling the toner mixture;

first pulverizing the toner mixture with a jet pulverizer having a collision plate and blowing compressed air; and second pulverizing the pulverized toner mixture with a rotor pulverizer having a container serving as an outer wall, and a rotor which is concentric with the container, while classifying the second pulverized toner mixture with an air classifier, wherein the rotor pulverizer is connected with the classifier, and wherein the second pulverizing step is performed the toner mixture circulates through the rotor pulverizer and the classifier.

9. An intermediate transfer material having a volume resistivity of from $10^9$ to $10^{13}$ Ω·cm, wherein a friction coefficient of a surface of the intermediate transfer material, which is to be contacted with the image bearing member, is not greater than 0.4.

10. The toner of claim 1, wherein the volume average particle diameter is not greater than 9 μm.

11. The toner of claim 1, wherein the toner has a circular degree of from 0.93 to 0.97.

12. The toner of claim 1, comprising fine toner particles having a particle diameter not greater than 5 μm in an amount of not greater than 20% by weight.

13. The toner of claim 1, further comprising a fluidity imparting agent.

14. The toner of claim 1, further comprising a particulate hydrophobic silica.

15. The toner of claim 1, further comprising a particulate hydrophobic titanium oxide.

16. The toner of claim 1, comprising a particulate hydrophobic silica and a particulate hydrophobic titanium oxide.

17. The toner of claim 14, wherein the particulate hydrophobic silica is present in an amount of from 0.3 to 1.5% by weight.

18. The toner of claim 15, wherein the particulate hydrophobic titanium oxide is present in an amount of from 0.2 to 1.2% by weight.

19. The toner of claim 1, further comprising a binder resin, a colorant and a charge controlling agent.

20. The toner of claim 19, wherein the binder resin is selected from the group consisting of polystyrene, polychlorostyrene, polyvinyl toluene, styrene copolymers, styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymer, polymethyl methacrylate, polybutyl methacrylate, polyvinyl chloride, polyvinyl acetate, polyesters, polyvinyl butyral resins, and polyacrylic acid resins.

21. The toner of claim 19, wherein the colorant is selected from the group consisting of Nigrosine dyes, Aniline Blue, chalco oil blue, Du Pont Oil Red, Quinoline Yellow, Methylene Blue chloride, Phthalocyanine Blue, Phthalocyanine Green, Hansa Yellow, Rhodamine 6C Lake, Chrome Yellow, quinacridone, Benzidine Yellow, Malachite Green, Malachite Green hexalate, Rose Bengal, monoazo dyes, monoazo pigments, diazo dyes, diazo pigments, trisazo dyes and trisazo pigments.

22. The toner of claim 19, wherein the charge controlling agent is selected from the group consisting of quaternary ammonium salts, metal salts of imidazole, metal complexes of imidazole, salts of salicylic acid, organic boron salts and calixaren compounds.

23. The toner of claim 19, further comprising a plasticizer.

24. The toner of claim 23, wherein the plasticizer is selected from the group consisting of dibutylphthalate and dioctylphthalate.

25. The toner of claim 19, further comprising a second fluidity imparting agent.

26. The toner of claim 25, wherein the second fluidity imparting agent is selected from the group consisting of fine powders of silica, titanium oxide, aluminum oxide, magnesium fluoride, silicon carbide, boron carbide, titanium carbide, zirconium carbide, boron nitride, titanium nitride, zirconium nitride, magnetite, molybdenum disulfide, fluorine-containing resins and acrylic resins.

* * * * *